US006681092B2

(12) United States Patent
Terai

(10) Patent No.: US 6,681,092 B2
(45) Date of Patent: Jan. 20, 2004

(54) DEVELOPER CARRIER HAVING GROOVES ON SURFACE THEREOF, DEVELOPING DEVICE INCLUDING THE DEVELOPER CARRIER, AND IMAGE FORMING APPARATUS INCLUDING THE DEVELOPING DEVICE

(75) Inventor: Junichi Terai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/357,393

(22) Filed: Feb. 4, 2003

(65) Prior Publication Data

US 2003/0170050 A1 Sep. 11, 2003

(30) Foreign Application Priority Data

Feb. 4, 2002 (JP) ..... 2002-026842
Jan. 26, 2003 (JP) ..... 2003-000118

(51) Int. Cl.[7] ..... G03G 15/08
(52) U.S. Cl. ..... 399/267; 399/279; 399/286
(58) Field of Search ..... 399/267, 279, 399/286

(56) References Cited

U.S. PATENT DOCUMENTS 5,051,760 A 9/1991 Shoji et al.
5,794,109 A * 8/1998 Ota et al. ..... 399/286
5,848,326 A 12/1998 Komuro et al.
6,337,957 B1 1/2002 Tamaki et al.

FOREIGN PATENT DOCUMENTS

EP 0 474 460 A2 * 3/1992
JP 2001-034070 2/2001
JP 2002-014539 1/2002

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A developing device for developing a latent image formed on an image carrier includes a developer carrier having a developer carrying surface. The developer carrying surface includes a plurality of grooves to carry the developer. Dispersion D (%) in depth of the plurality of grooves is calculated according to an equation, D (%)={(A−B)/2}/C, where A is a maximum depth of the plurality of grooves, B is a minimum depth of the plurality of grooves, and C is an average depth of the plurality of grooves. The dispersion D (%) is at most approximately 30%.

28 Claims, 10 Drawing Sheets

DEVELOPER CARRIER HAVING GROOVES ON SURFACE THEREOF, DEVELOPING DEVICE INCLUDING THE DEVELOPER CARRIER, AND IMAGE FORMING APPARATUS INCLUDING THE DEVELOPING DEVICE

CROSS-REFERENCE TO RELATED APPLICATIONS

The present application claims priority to Japanese Patent Application No. 2002-026842 filed in the Japanese Patent Office on Feb. 4, 2002 and Japanese Patent Application No. 2003-000118 filed in the Japanese Patent Office on Jan. 6, 2003, the disclosures of which are hereby incorporated by reference herein in their entirety.

BACKGROUND OF THE INVENTION

1. Field of the Invention

The present invention relates to a developing device and an image forming apparatus including the developing device such as a copying machine, a printer, a facsimile machine, or other similar image forming apparatus, and more particularly to a developer carrier in the developing device that carries a developer thereon to develop a latent image formed on an image carrier.

2. Discussion of the Background

In a background developing device that develops a latent image formed on an image carrier with a developer in an image forming apparatus such as a copying machine, a printer, a facsimile machine, or other similar image forming apparatus that forms images at a high speed or a middle speed, a surface of a developing sleeve as an example of a developer carrier is subjected to a sandblast treatment or a groove treatment to impart an appropriate surface roughness. Such a treatment is performed to prevent the decrease of image density caused by the developer that slips and remains on the developing sleeve rotating at a high speed.

In the case of the sandblast treatment, materials of a developing sleeve can be aluminum, brass, stainless, conductive resin, etc. In view of cost and accuracy in shape, aluminum is generally used as the material of the developing sleeve. When a surface of a developing sleeve made of aluminum is subjected to a sandblast treatment, concave/convex portions are formed on the surface of the developing sleeve by spraying abrasive grains on the surface of a cold aluminum tube in a shape of sleeve which has been extruded at a high temperature. The surface roughness of the developing sleeve is generally in a range of about 5 $\mu$m to 15 $\mu$m in a ten point mean surface roughness (Rz) scale, which is prescribed in JIS (Japanese Industrial Standards). In the developing sleeve subjected to a sandblast treatment, even though the developing sleeve rotates at a high speed, developer is caught in concave/convex portions formed on the surface of the developing sleeve, and thereby the slip of the developer on the surface of the developing sleeve is obviated.

However, in the developing sleeve subjected to a sandblast treatment, concave/convex portions on the surface of the developing sleeve are abraded with time, thereby deteriorating a developer conveying capability of the developing sleeve. Therefore, a problem of durability of the developing sleeve occurs. Such a problem of durability may be improved by using stainless having high hardness as a material of a developing sleeve or by performing a hardening treatment on a surface of a developing sleeve. However, this results in an increase of cost.

In the case of the groove treatment, materials of a developing sleeve can be aluminum, brass, stainless, conductive resin, etc. In view of cost and accuracy, similarly as in the sandblast treatment, aluminum is generally used as the material of the developing sleeve. When a surface of a developing sleeve made of aluminum is subjected to a groove treatment, an aluminum tube in a shape of sleeve extruded at a high temperature is cooled, and grooves are formed on the surface of the aluminum tube in a shape of sleeve by use of a die. Each of the grooves typically has a cross-section of trapezoid-shape, V-shape, U-shape or the like. The depth of each of the grooves measured from the surface of the developing sleeve is about 0.2 mm. The number of grooves of the developing sleeve having an outer diameter of, for example, 25 mm is typically about 50. In the developing sleeve subjected to a groove treatment, even though the developing sleeve rotates at a high speed, developer is caught in grooves formed on the surface of the developing sleeve, and thereby the slip of the developer on the surface of the developing sleeve is obviated. As compared to the developing sleeve subjected to the sandblast treatment, grooves are not largely abraded even in a long period of use, and the developing sleeve can stably convey the developer.

However, in the developing sleeve subjected to the above-described groove treatment, periodical variations in an image density caused by grooves, that is, an uneven density in a form of a groove pitch typically (hereafter simply referred to as a "groove pitch-like uneven density") occurs. Generally, as a depth of groove increases, the developer conveying capability of a developing sleeve enhances, but the groove pitch-like uneven density tends to occur. On the other hand, as a depth of groove decreases, the groove pitch-like uneven density does not tend to occur, but the developer conveying capability of a developing sleeve deteriorates. Especially, recently, as image reproducibility has been improved due to the enhanced image forming technique of development using small-particulate toner and carrier and of development by a developing device in which an image carrier and a developer carrier are provided close to each other, the groove pitch-like uneven density tends to occur.

To prevent occurrence of a groove pitch-like uneven density and to maintain a developer conveying capability of a developing sleeve, the inventor has proposed a developer carrier in which a depth of each of grooves is set in an optimal range. In this proposed developer carrier, a depth of each of grooves is set to be relatively smaller than before, specifically in a range of 0.05 mm to 0.15 mm.

However, when performing an image forming operation by use of the above-described proposed developer carrier, an uneven image density in a relatively long period corresponding to one rotation of the developer carrier (hereafter referred to as a "periodic uneven image density") occurred. As a cause of such a periodic uneven image density has been considered to be an eccentricity of the developer carrier, an amount of eccentricity of the developer carrier was measured. However, the measured amount of eccentricity of the developer carrier was not to a degree which causes the periodic uneven image density.

Therefore, it is desirable to provide a developer carrier which has a plurality of grooves on a surface thereof and does not cause the periodic uneven image density.

SUMMARY OF THE INVENTION

According to one aspect of the present invention, a developer carrier includes a developer carrying surface configured to carry a developer thereon to develop a latent image formed on an image carrier. The developer carrying surface includes a plurality of grooves to carry the developer. Dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

According to another aspect of the present invention, a developing device for developing a latent image formed on an image carrier includes a developer carrier. The developer carrier includes a developer carrying surface that is configured to carry a developer thereon to develop a latent image formed on an image carrier. The developer carrying surface includes a plurality of grooves to carry the developer. Dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

According to further aspect of the present invention, an image forming apparatus includes an image carrier configured to carry an image, a latent image forming device configured to form an electrostatic latent image on a surface of the image carrier, and a developing device configured to develop the electrostatic latent image to form a toner image on the image carrier. The developing device includes a developer carrier. The developer carrier has a developer carrying surface configured to carry a developer thereon to develop a latent image formed on an image carrier. The developer carrying surface includes a plurality of grooves to carry the developer. Dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

According to yet further aspect of the present invention, a process cartridge for use in an image forming apparatus includes an image carrier configured to carry an image, a developing device configured to develop an electrostatic latent image to form a toner image on the image carrier. The developing device includes a developer carrier having a developer carrying surface. The developer carrying surface is configured to carry a developer thereon to develop a latent image formed on an image carrier. The developer carrying surface includes a plurality of grooves to carry the developer. Dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
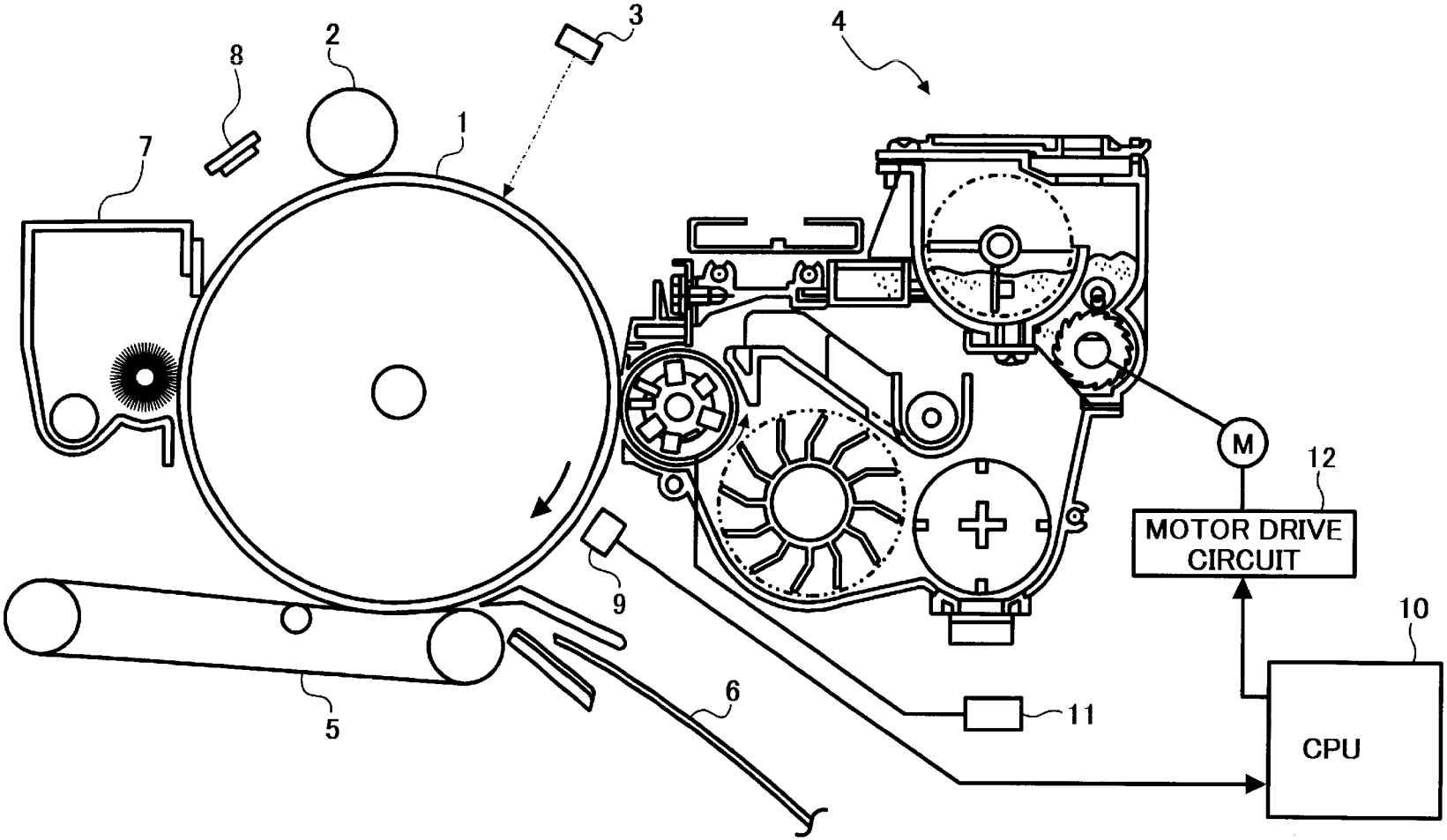
FIG. 1 is a schematic view of a main construction of a printer according to one embodiment of the present invention.

Preferred embodiments of the present invention are described in detail referring to the drawings, wherein like reference numerals designate identical or corresponding parts throughout the several views.

A laser printer (hereafter referred to as a "printer") as an example of an image forming apparatus to which the present invention is applied will be described. FIG. 1 is a schematic view of a main construction of the printer according to one embodiment of the present invention. Referring to FIG. 1, the printer includes a photoconductive drum 1 serving as an image carrier. Arranged around the photoconductive drum 1 are a charging device 2, an exposure device 3, a developing device 4, a transfer device 5, a cleaning device 7, and a discharging device 8 in the order of the rotational direction of the photoconductive drum 1 indicated by an arrow on the photoconductive drum 1.

While rotating the photoconductive drum 1, the surface of the photoconductive drum 1 is uniformly charged by a charging roller in the charging device 2. Then, the exposure device 3 serving as a latent image forming device, irradiates the charged surface of the photoconductive drum 1 with a laser beam, thereby forming an electrostatic latent image on the photoconductive drum 1.

The developing device 4 develops the electrostatic latent image with a developer including toner and carrier, and forms a toner image on the photoconductive drum 1. With regard to development conditions, the surface of the photoconductive drum 1 charged at approximately −700V is exposed to the laser beam emitted from the exposure device 3, and thereby the surface potential of an electrostatic latent image portion on the photoconductive drum 1 is attenuated to approximately −150V. The development is performed by applying a developing bias of −550V from a developing bias power supply 11 to a developing roller 41 serving as a developer carrier in the developing device 4.

The transfer device 5 including a transfer belt, drive/driven rollers, and a bias roller transfers the toner image from the surface of the photoconductive drum 1 to a recording sheet 6 conveyed from a sheet feeding tray (not shown). The transferred toner image on the recording sheet 6 is fixed thereonto in a fixing device (not shown). The cleaning device 7 cleans residual toner remaining on the photoconductive drum 1 after the toner image is transferred from the photoconductive drum 1 to the recording sheet 6. Subsequently, the surface of the photoconductive drum 1 is uniformly discharged by the discharging device 8 to be prepared for a next image forming process.

In order to suppress variations in image quality due to changes in environmental conditions and with time, a process control is performed in the printer. Specifically, the developing capability of the developing device 4 is judged. For example, a latent image of toner pattern is formed on the photoconductive drum 1, and is developed by the developing device 4 with a developer under the condition of a steady developing bias voltage. Then, the density of developed image is detected by an optical sensor 9, and the developing capability of the developing device 4 is judged by a central processing unit (CPU) 10 based on the detected value. By changing a target value of the density of toner in the developer such that the developing device 4 achieves a target developing capability, an image quality can be maintained at a predetermined level. For example, when the value of the image density of the toner pattern formed on the photoconductive drum 1 detected by the optical sensor 9 is less than a target value of image density, the CPU 10 controls a motor drive circuit 12 to increase the density of toner in the developer. When the value of the image density of the toner pattern formed on the photoconductive drum 1 detected by the optical sensor 9 is greater than a target value of image density, the CPU 10 controls the motor drive circuit 12 to decrease the density of toner in the developer.

Figure 2:
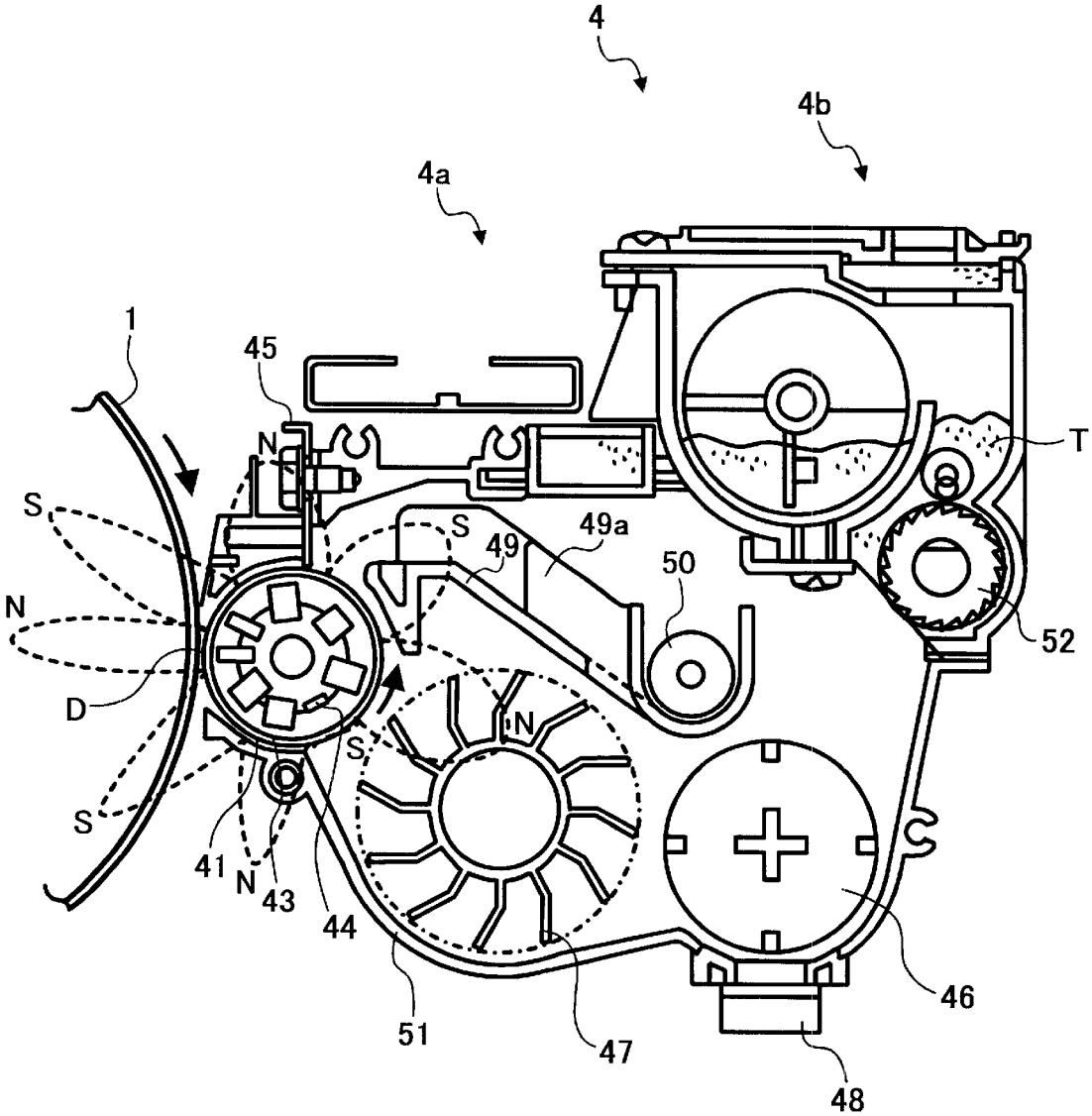
FIG. 2 is a schematic view of a construction of a developing device in the printer of FIG. 1.

In the printer of FIG. 1, the above-described density of toner in the developer is detected by a toner density sensor 48 illustrated in FIG. 2. The image density of the toner pattern formed on the photoconductive drum 1 may vary in some degree due to the periodic uneven image density caused by the developing sleeve 43.

Next, a construction of the developing device 4 will be described referring to FIG. 2. The developing device 4 includes a developing unit 4*a* and a toner replenishing unit 4*b*. The developing unit 4*a* includes the developing roller 41 disposed close to the photoconductive drum 1. A developing region (D) is formed at a position where the developing roller 41 and the photoconductive drum 1 face each other.

The developing roller 41 includes a non-magnetic cylindrical-shaped developing sleeve 43 made of aluminum, brass, stainless, conductive resin, etc. The developing sleeve 43 is rotated by a drive mechanism (not shown) in a direction indicated by an arrow in FIG. 2, i.e., in a counterclockwise direction. In the developing sleeve 43, a magnet roller 44 is disposed in a stationary condition to generate a magnetic field that causes the developer to rise in the form of magnet brush on the surface of the developing sleeve 43.

The carrier contained in the developer is caused to rise in the form of chain on the surface of the developing sleeve 43 along magnetic lines of force generated from the magnet roller 44. The charged toner is attached onto the carrier in the form of chain, thereby forming a magnet brush. The magnet brush is conveyed in the same direction as the rotating direction of the developing sleeve 43 (i.e., in a counterclockwise direction) by the rotation of the developing sleeve 43. At the upstream side of the developing region (D) with respect to a direction in which the developing sleeve 43 conveys the developer, a doctor blade 45 is provided to regulate a height of the developer brush, that is, an amount of the developer.

The developing unit 4*a* further includes a developer agitating roller 46 and a paddle wheel 47. The developer is mixed and agitated by the developer agitating roller 46 and is scooped up by the paddle wheel 47. The developing roller 41, the paddle wheel 47, and the developer agitating roller 46 are accommodated in a developer case 51 as a developer accommodating member.

When the toner density sensor 48 detects the decrease of toner density in the developer to be supplied to the photoconductive drum 1, toner (T) is fed from the toner replenishing unit 4*b* toward the developer agitating roller 46 by rotating a toner replenishing roller 52.

In the developing unit 4*a*, a separator 49 is disposed such that one end of the separator 49 in the extending direction thereof is located close to the doctor blade 45 and the other end of the separator 49 in the extending direction thereof is located above the developer agitating roller 46. Further, a rotatable developer conveying screw 50 is provided at the other end of the separator 49.

In the above-described developing unit 4*a*, the developer is scooped up by the rotation of the paddle wheel 47, and is supplied to the developing roller 41. The developing roller 41 carries the developer on the surface thereof under the influence of the magnetic force of the magnet roller 44. The developer carried on the developing roller 41 is conveyed in the direction indicated by the arrow in FIG. 2 by the rotation of the developing sleeve 43, and the thickness of the developer on the developing roller 41 is regulated by the doctor blade 45 to be decreased. The developing roller 41 conveys the regulated developer to the developing region (D) where the developing roller 41 opposes the photoconductive drum 1. The developer having passed through the developing region (D) is further conveyed by the developing roller 41 to a position where the magnetic force of the magnet roller 44 does not affect, and falls toward the developer case 51 adjacent to the paddle wheel 47. The fallen developer is agitated again by the paddle wheel 47.

The developer that is regulated by the doctor blade 45 is conveyed in a direction substantially perpendicular to the sheet of FIG. 2 (i.e., toward a rear side of the developing device 4 in FIG. 2) by a plurality of slanted fins 49*a* provided on the separator 49. A developer guide path (not shown) is provided at the end of the separator 49 in the direction substantially perpendicular to the sheet of FIG. 2 to direct the regulated developer to the developer conveying screw 50. The developer is further conveyed by the developer conveying screw 50 toward a front side of the developing device 4 in FIG. 2, and falls through slits (not shown) provided opposite to the developer agitating roller 46. As described above, because the developer is conveyed toward the rear side and front side of the developing device 4, the developer is mixed such that toner density becomes even in the developing unit 4*a*. Further, by setting conveyance amounts of the developer at the respective rear and front sides of the developing device 4 equally, the distribution of the developer in the developing unit 4*a* can be adequately maintained.

Figure 3:
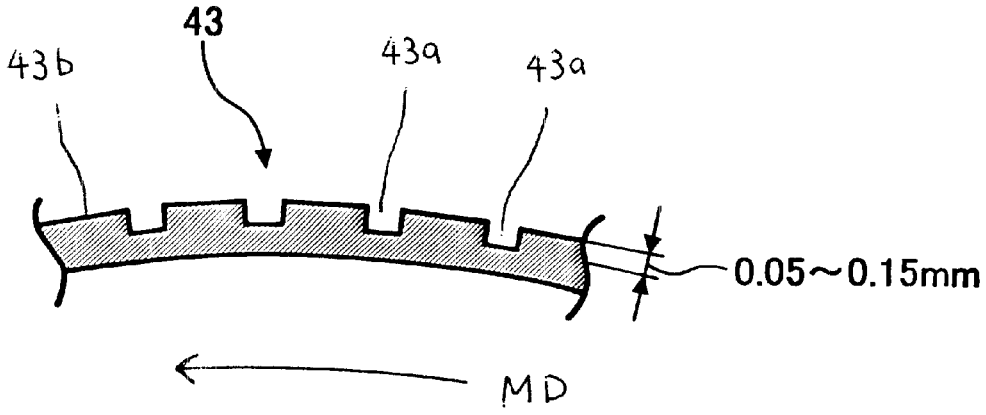
FIG. 3 is an enlarged view of a partial, cross section of a developing sleeve seen from the axial direction of the developing sleeve.
Figure 4:
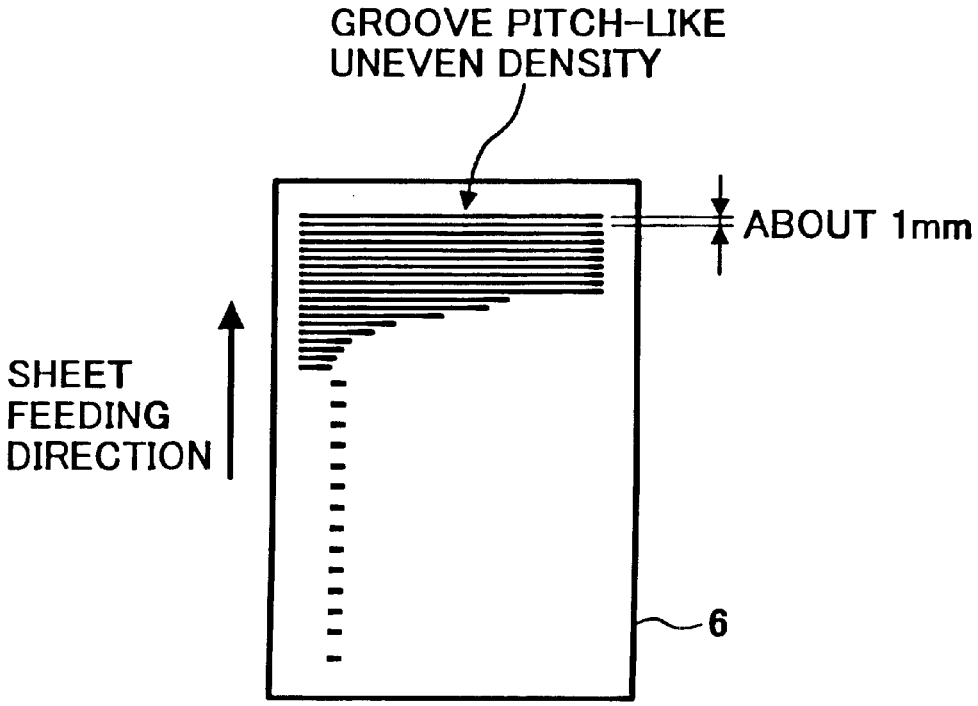
FIG. 4 is a view for explaining a groove pitch-like uneven density on a recording sheet.

Next, a description will be given of the developing sleeve 43. FIG. 3 is an enlarged view of a partial cross section of the developing sleeve 43 seen from the axial direction of the developing sleeve 43. A plurality of grooves (43*a*) having uniform intervals are formed on the developer carrying surface (43*b*) of the developing sleeve 43. The plurality of grooves (43*a*) extend in substantially parallel with an axial direction of the developing sleeve 43. Namely, the grooves (43*a*) extend in a direction substantially perpendicular to a moving direction "MD" of the developing sleeve 43. Generally, as the depth of grooves increases, the developer conveyance capability of the developing sleeve 43 enhances. However, for example, a groove pitch-like uneven density tends to occur at about 1 mm intervals as illustrated in FIG. 4. On the other hand, as the depth of grooves decreases, such a groove pitch-like uneven density does not tend to occur. However, the developer conveyance capability of the developing sleeve 43 is deteriorated. Especially, recently, as image reproducibility has been improved due to the enhanced image forming technique of development using small-particulate toner and carrier and of development by a developing device in which an image carrier and a developer carrier are provided close to each other, the groove pitch-like uneven density tends to occur. Therefore, by setting the depth of each of the grooves of the developing sleeve 43 to be smaller than that of a background developing sleeve, problems such as inferior developer conveyance and occurrence of groove pitch-like uneven density can be overcome. Specifically, the depth of each of the grooves of the developing sleeve 43 is set to be in a range of about 0.05 mm to about 0.15 mm.

The mechanical conditions and developer conditions in the printer were as follows:

Mechanical Conditions

Linear velocity of photoconductive drum 1:

360 mm/sec (can be set in a range of 100 to 500 mm/sec)

Gap between the developing sleeve 43 and the photoconductive drum 1: 0.3–0.6 mm Gap between the developing sleeve 43 and the doctor blade 45: 0.3–0.6 mm Outer diameter of the developing sleeve 43:

25 mm (can be set in a range of 16 to 40 mm) Ratio of linear velocity of the developing sleeve 43 relative to linear velocity of the photoconductive drum 1:

2 (can be set in a range of 1.5 to 3)

| | |
|---|---|
| Number of grooves of the developing sleeve 43: | 100 |
| Resistance of the developing sleeve 43: | 100 Ω or less |
| Magnet force of the magnet roller 44: | 60–140 mT |
| <Developer conditions> | |
| Carrier (magnetite, iron, or ferrite) | 30 to 80 μm |
| Toner | |
| Amount of magnetic material: | 15–50% by weight |
| Amount of silica: | 0.1–1.0% by weight |
| Volume average particle diameter: | 5–9.5 μm |
| Toner covering ratio of carrier: | 50 to 120% |
| Charging amount of toner (Q/M) | 15 to 50 μc/g |

Figure 5:
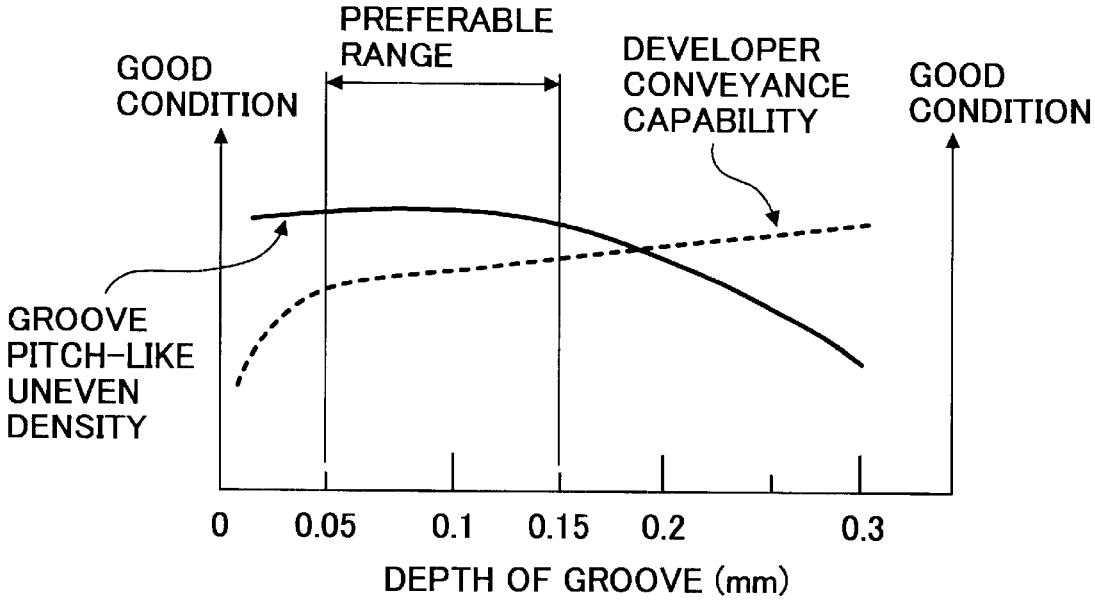
FIG. 5 is a graph showing a relationship between a depth of grooves of the developing sleeve, and conditions of groove pitch-like uneven density and a developer conveyance capability based on experimental results.

FIG. 5 is a graph showing a relationship between a depth of grooves and conditions of groove pitch-like uneven density and developer conveyance capability based on experimental results. As seen from FIG. 5, when the depth of the grooves of the developing sleeve 43 is greater than about 0.15 mm, even though the developer conveyance capability of the developing sleeve 43 enhances, the groove pitch-like uneven density tends to occur.

The cause of the occurrence of groove pitch-like uneven density is considered as follows. When the depth of the grooves of the developing sleeve 43 is greater than about 0.15 mm, an electric field for development between the photoconductive drum 1 and the grooves of the developing sleeve 43 gets weakened when the photoconductive drum 1 opposes the grooves of the developing sleeve 43 at the developing region (D) formed between the photoconductive drum 1 and the developing roller 41. As a result, the development capability of the developing roller 41 deteriorates, and thereby an image density of a developed toner image on a portion of the photoconductive drum 1 opposite to the grooves of the developing sleeve 43 decreases.

When the depth of the grooves of the developing sleeve 43 is smaller than about 0.05 mm, the groove pitch-like uneven density does not occur, but the developer conveying capability of the developing sleeve 43 deteriorates. The cause of the deterioration of the developer conveying capability of the developing sleeve 43 is considered that when the depth of the grooves of the developing sleeve 43 is smaller than about 0.05 mm, the developer slips on the developing sleeve 43, and the amount of developer conveyed by the grooves decreases. Thus, by setting the depth of the grooves of the developing sleeve 43 to be in a range of about 0.05 mm to about 0.15 mm, that is, relatively smaller than a depth of grooves of a background developing sleeve, problems such as inferior developer conveyance and occurrence of groove pitch-like uneven density can be overcome.

As compared to concave/convex portions on a surface of a developing sleeve formed by a sandblast treatment, the depth of the grooves as concave portions of the developing sleeve 43 is greater. Therefore, as compared to concave/convex portions on a surface of a developing sleeve formed by the sandblast treatment, the grooves of the developing sleeve 43 do not tend to be abraded. Further, even after a relatively long period of time elapses, the developer conveyance capability of the developing sleeve 43 is maintained, and thereby a stable image density can be maintained. Moreover, even if the printer prints at a high speed, the developing sleeve 43 can maintain the developer conveyance capability. Further, because an image density of a toner pattern formed on the photoconductive drum 1 at the time of process control is stabilized, an adequate process control can be performed.

As described above, by setting the depth of the grooves of the developing sleeve 43 to be in a range of about 0.05 mm to about 0.15 mm, problems such as inferior developer conveyance and occurrence of groove pitch-like uneven density can be overcome.

Figure 6:
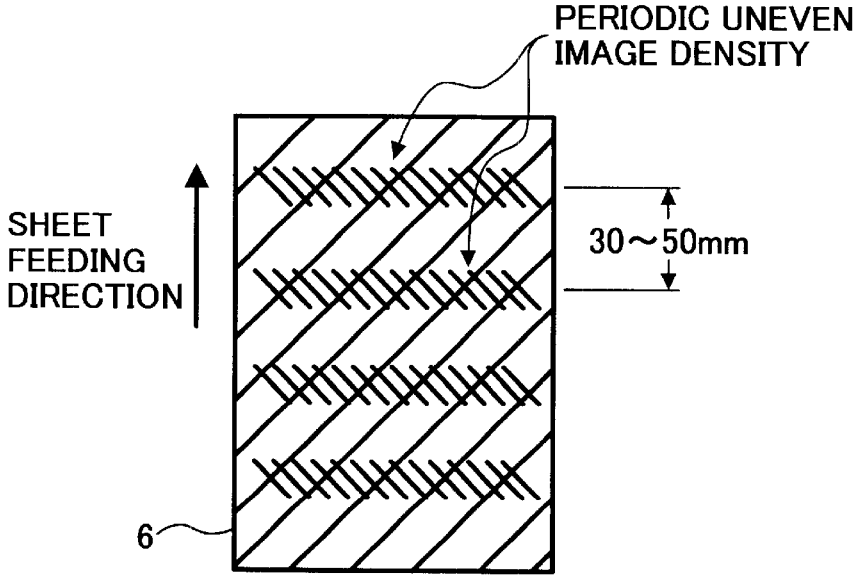
FIG. 6 is a view for explaining a periodic uneven image density.

However, when an image forming operation is performed by using the developing sleeve 43, as illustrated in FIG. 6, periodic uneven image density occurs on the recording sheet 6 at relatively long intervals of from 30 mm to 50 mm. As the outer diameter of the developing sleeve 43 is 25 mm, the outer peripheral length of the developing sleeve 43 is 78.5 mm. As the linear velocity ratio of the developing sleeve 43 relative to the photoconductive drum 1 is 2, the length about 39 mm on an image corresponds to the one rotation of the developing sleeve 43. Therefore, the period of uneven image density generated on the recording sheet 6 substantially corresponds to the period of one rotation of the developing sleeve 43. Because such a periodic uneven image density is often caused by the eccentricity of a developing sleeve, the inventor measured an amount of the eccentricity of the developing sleeve 43. The amount of eccentricity of the developing sleeve 43 was not so large as to cause the periodic uneven image density.

Figure 7:
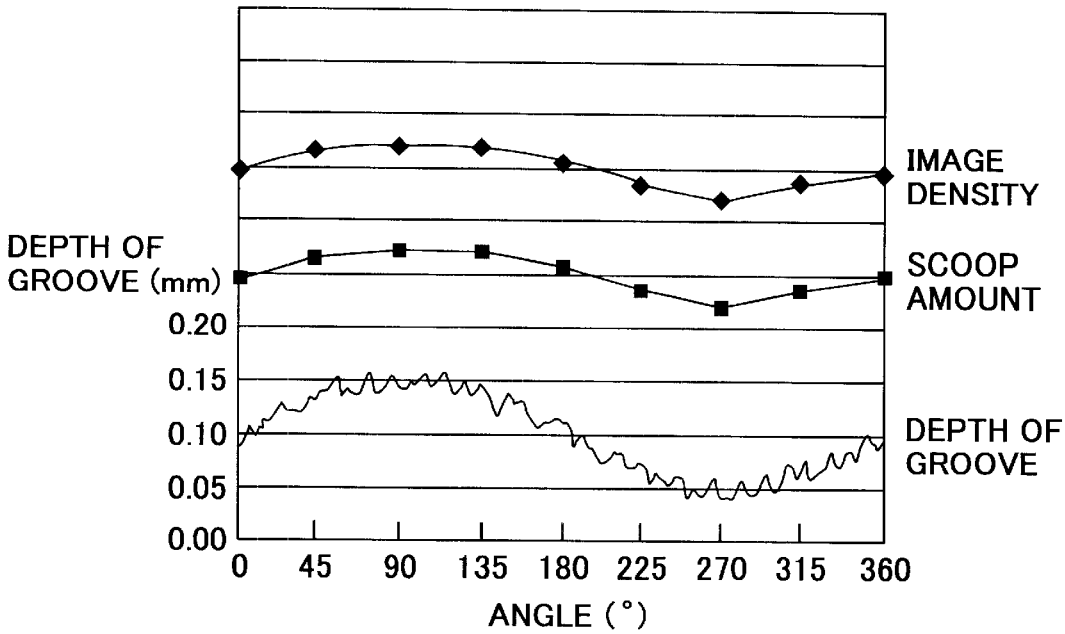
FIG. 7 is a graph showing a relationship between a depth of grooves of the developing sleeve, an image density, and an amount of developer scooped up by the developing sleeve.

When the inventor measured the depths of the plurality of grooves formed on the surface of the developing sleeve 43 with laser beam, dispersion in groove depths in the circumferential direction of the developing sleeve 43 was found as shown in a graph of FIG. 7. In addition, it was found that at the shallow grooves, the amount of developer scooped up by the developing sleeve 43 is decreased, thereby decreasing an image density of a toner image. On the other hand, it was found that at the deep grooves, the amount of developer scooped up by the developing sleeve 43 is increased, thereby increasing an image density of a toner image.

Figure 8:
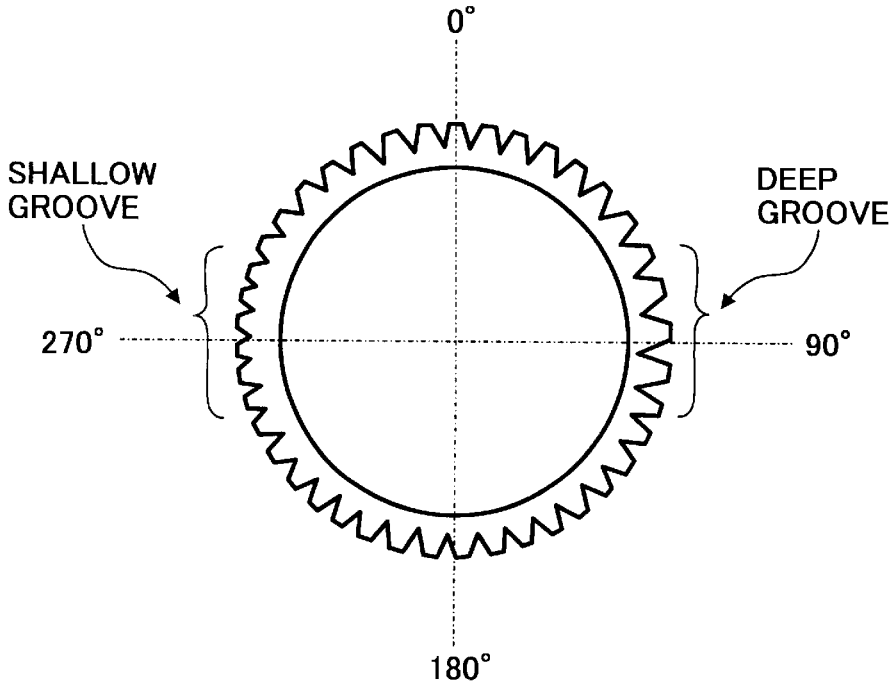
FIG. 8 is a schematic view for explaining dispersion of depth of grooves of the developing sleeve.

FIG. 8 is a schematic sectional view of the developing sleeve 43 showing dispersion (D) in depth of the grooves of the developing sleeve 43. The cause of the dispersion (D) in depths of the grooves formed on the surface of the developing sleeve 43 is considered as follows. The grooves of the developing sleeve 43 are formed by use of a die. In this case, when forming shallow grooves, if grooves are formed at the same accuracy level (i.e., within the same error) as in the case of forming deep grooves, dispersion (D) in depth of the shallow grooves results in getting great relatively to that of the deep grooves. The dispersion (D) (%) in depth of the grooves of the developing sleeve 43 is obtained by the following calculation:

$$D(\%)=\{(A-B)/2\}/C \quad (1)$$

where A is a maximum depth of grooves, B is a minimum depth of grooves, and C is an average depth of grooves. The average depth C is a depth averaging the depth dispersion. Namely, an integrated depth is obtained by integrating the depth of the groove along the entire circumference of the groove. Then, the average depth C is obtained by dividing the integrated depth by the length of the entire circumference of the groove.

As seen from the measurement results of the depth of the grooves of the developing sleeve 43 shown in FIG. 7, the maximum depth of grooves was 0.15 mm, the minimum depth of grooves was 0.05 mm, and the average depth of grooves was 0.1 mm. When applying these values to the calculation (1), the dispersion (D) (%) in depth of the grooves of the developing sleeve 43 is obtained as follows:

$$\{(0.15-0.05)/2\}/0.1=50\%$$

When the dispersion (D) (%) in depth of the grooves of the developing sleeve 43 is 50%, the periodic uneven image density like one illustrated in FIG. 6 typically occurs.

The inventor prepared three types of developing sleeves having dispersion (D) in depth of grooves of about 20%, about 30%, and about 40%. Experiments for an evaluation of periodic uneven image density were performed by executing an image forming operation by use of the above three types of developing sleeves under the same conditions. As a result, when using the developing sleeve having dispersion in depth of the grooves of about 20%, the amount of the developer scooped up by the developing sleeve was stable, and a good quality image without periodic uneven image density was obtained.

When using the developing sleeve having dispersion in depth of the grooves of about 30%, dispersion of the amount of the developer scooped up by the developing sleeve was suppressed, and periodic uneven image density was inconspicuous and at an allowable level. When using the developing sleeve having dispersion in depth of the grooves of about 40%, the amount of the developer scooped up by the developing sleeve was uneven, and an image with conspicuous periodic uneven image density was obtained. Therefore, it was found that the dispersion (%) of the depth of grooves of the developing sleeve was preferably about 30% or less, and more preferably about 20% or less.

As described above, in order to prevent the periodic uneven image density, it was found to be effective that the dispersion in depth of grooves of the developing sleeve should be decreased. However, the decrease of dispersion in depth of grooves of the developing sleeve more than necessary results in the increase of cost. There are, for example, three methods of groove treatment for a surface of a developing sleeve as follows: (1) an aluminum tube in a shape of sleeve extruded at a high temperature is cooled, and grooves are formed on the surface of the aluminum tube in a shape of sleeve by use of a die; (2) an aluminum tube in a shape of sleeve is extruded in a mold in which grooves are formed; (3) an extruded aluminum tube in a shape of sleeve is cooled, and grooves are formed on the surface of the aluminum tube in a shape of sleeve by cutting.

In order to decrease the dispersion in depth of grooves of the developing sleeve, the method of forming grooves by cutting is the most effective in the above-described three methods. However, the cost of forming grooves by cutting is much higher than that of forming grooves by use of a die. Although it may differ depending on the number of grooves formed on a developing sleeve, the cost of forming grooves by cutting is approximately from 20 to 50 times higher than that of forming grooves by use of a die. In consideration of the cost of forming grooves, the dispersion in depth of the grooves of the developing sleeve 43 is set to about 5% or greater in this embodiment. If this value (i.e., about 5% or greater) is acceptable, grooves may be formed on the surface of the developing sleeve by use of a die at lower cost.

Figure 9:
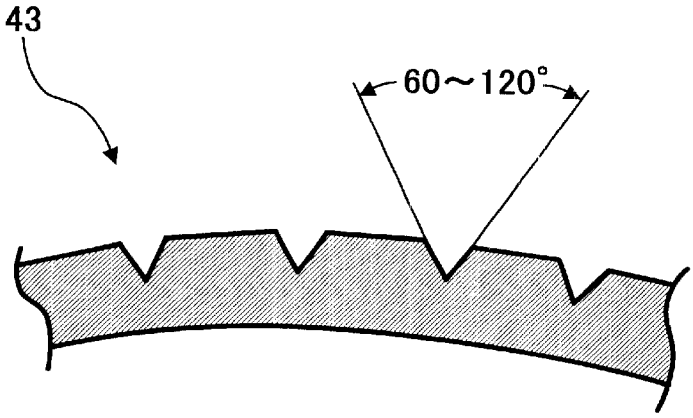
FIG. 9 is a schematic view for explaining V-shaped grooves formed on the developing sleeve.
Figure 10:
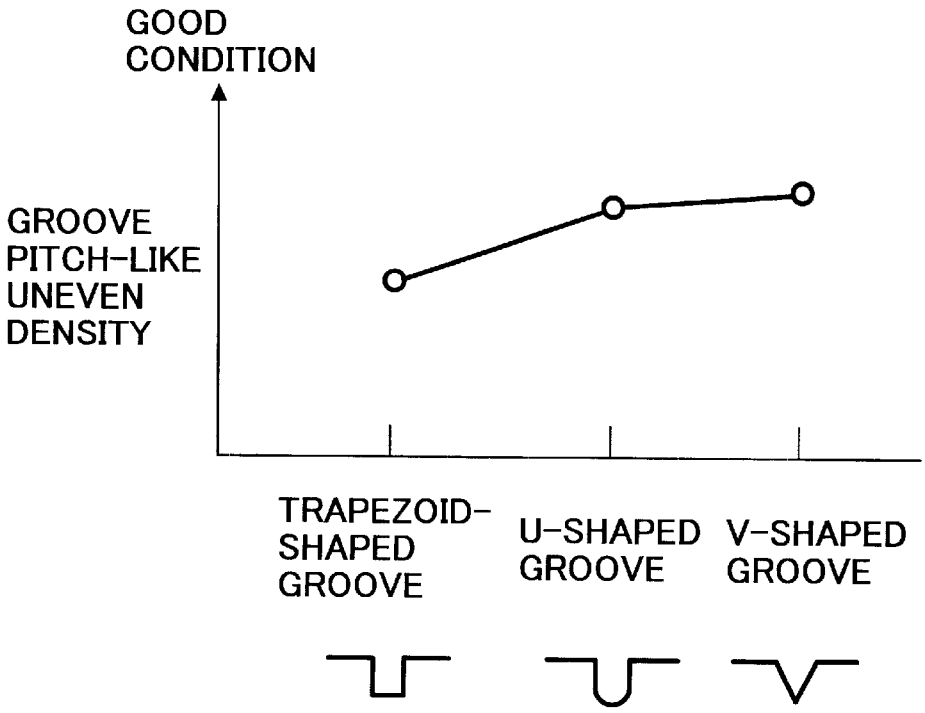
FIG. 10 is a graph showing a relationship between a shape of the groove of the developing sleeve and a condition of groove pitch-like uneven density based on experimental results.

With regard to a shape of the groove formed on the surface of the developing sleeve 43, a V-shaped groove illustrated in FIG. 9 is effective for preventing the groove pitch-like uneven density. Experiments on a condition of the groove pitch-like uneven density are performed while changing the shape of the groove of the developing sleeve 43. FIG. 10 is a graph showing a relationship between a shape of the groove formed on the surface of the developing sleeve 43 and a condition of groove pitch-like uneven density based on experimental results. As seen from FIG. 10, as compared to grooves of trapezoid-shape and of U-shape, the groove pitch-like uneven density was inconspicuous in the case of the V-shaped groove. The reason of these experimental results is considered as follows. As compared to the grooves of trapezoid-shape and U-shape steeply inclined toward the bottom of the grooves, the V-shaped groove is gradually inclined toward the bottom of the groove. When the grooves of the developing sleeve 43 oppose the photoconductive drum 1 at the developing region (D), the electric field for development is gradually changed in magnitude, and thereby the difference in an image density becomes inconspicuous.

Figure 11:
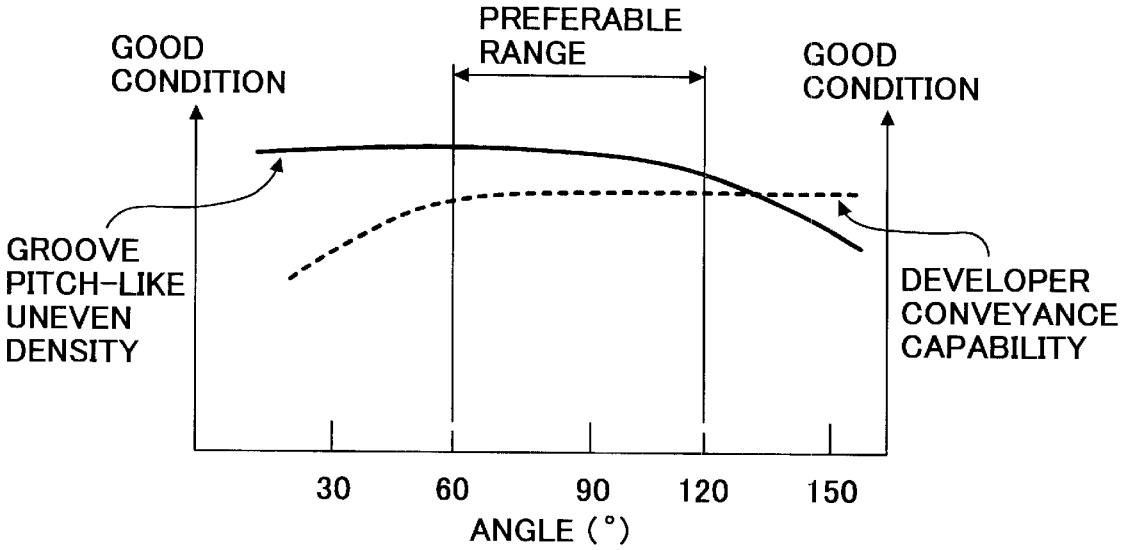
FIG. 11 is a graph showing a relationship between an angle formed between two lines of a V-shaped groove and conditions of developer conveyance capability of the developing sleeve and groove pitch-like uneven density based on experimental results.

Further, an angle formed between two lines of the V-shaped groove is preferably in a range of about 60 degrees to about 120 degrees for enhancing the developer conveyance capability and for avoiding the groove pitch-like uneven density. FIG. 11 is a graph showing a relationship between an angle formed between two lines of the V-shaped groove and conditions of the developer conveyance capability of the developing sleeve 43 and the groove pitch-like uneven density based on experimental results. As seen from FIG. 11, when the angle formed between the two lines of the V-shaped groove is less than about 60 degrees, the developer conveyance capability of the developing sleeve 43 deteriorates. When the angle formed between the two lines of the V-shaped groove is less than about 60 degrees, the developer may slip on the developing sleeve 43, and the amount of the developer conveyed by the grooves of the developing sleeve 43 decreases.

When the angle formed between the two lines of the V-shaped groove is greater than about 120 degrees, the groove pitch-like uneven density tends to be conspicuous. The reasons are considered as follows. When the photoconductive drum 1 opposes the groove of the developing sleeve 43, the electric field generated between the photoconductive drum 1 and the groove of the developing sleeve 43 becomes weakened, resulting in deterioration of development capability of the developing roller 41. In this case, because a width of the groove is wide when the angle formed between the two lines of the V-shaped groove is greater than about 120 degrees, an area of the developed image of low density expands, thereby causing the groove pitch-like uneven density to be conspicuous.

For the above-described reasons, in order to enhance the developer conveyance capability and prevent the occurrence of groove pitch-like uneven density, the developing sleeve 43 has V-shaped grooves on the surface thereof, and the angle formed between the two lines of the V-shaped groove is set to be in a range of about 60 degrees to about 120 degrees.

Figure 12:
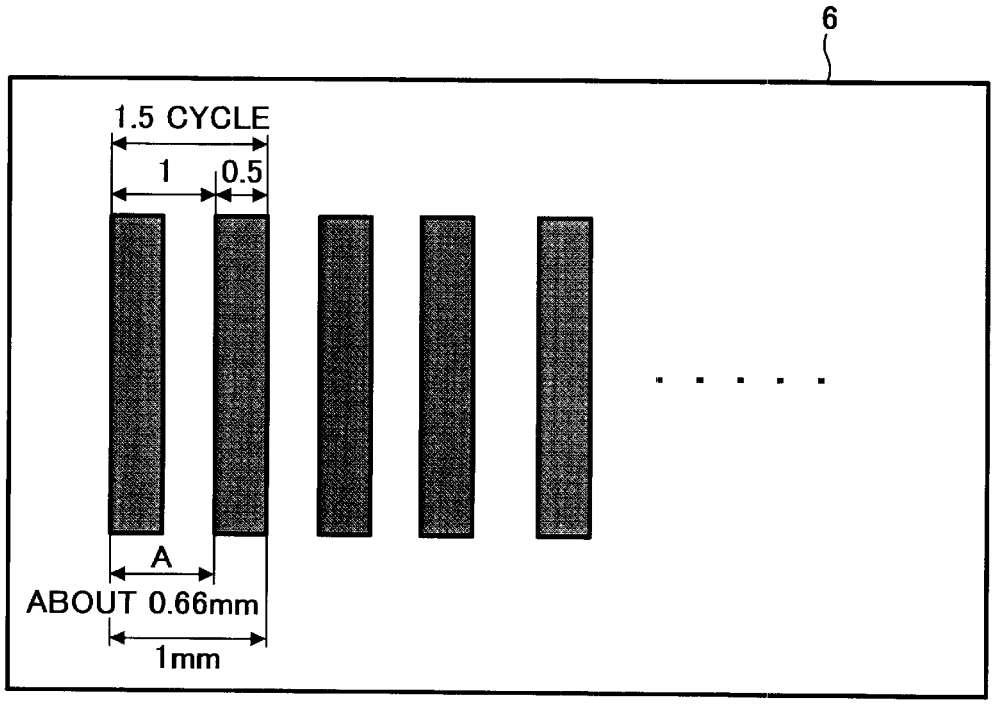
FIG. 12 is a schematic view for explaining a spatial frequency of an image caused by the grooves of the developing sleeve.

Further, based on experiments, it was found that when a spatial frequency of an image caused by the grooves of the developing sleeve 43 was 1.5 cycle/mm or greater, it was effective at preventing the occurrence of groove pitch-like uneven image density. FIG. 12 is a schematic enlarged view of an image developed by the developing sleeve 43 on the recording sheet 6. As illustrated in FIG. 12, the spatial frequency of the image is approximately 1.5 cycle/mm. In this condition, a pitch indicated by a double-headed arrow (A) in an image on the recording sheet 6 corresponds to about 0.66 mm. Generally, it has been said that the naked eye is most sensitive to a pitch of about 1 mm. Therefore, a groove pitch-like uneven density in an image having a pitch of less than 1 mm (i.e., having greater spatial frequency) tends to be inconspicuous.

Figure 13:
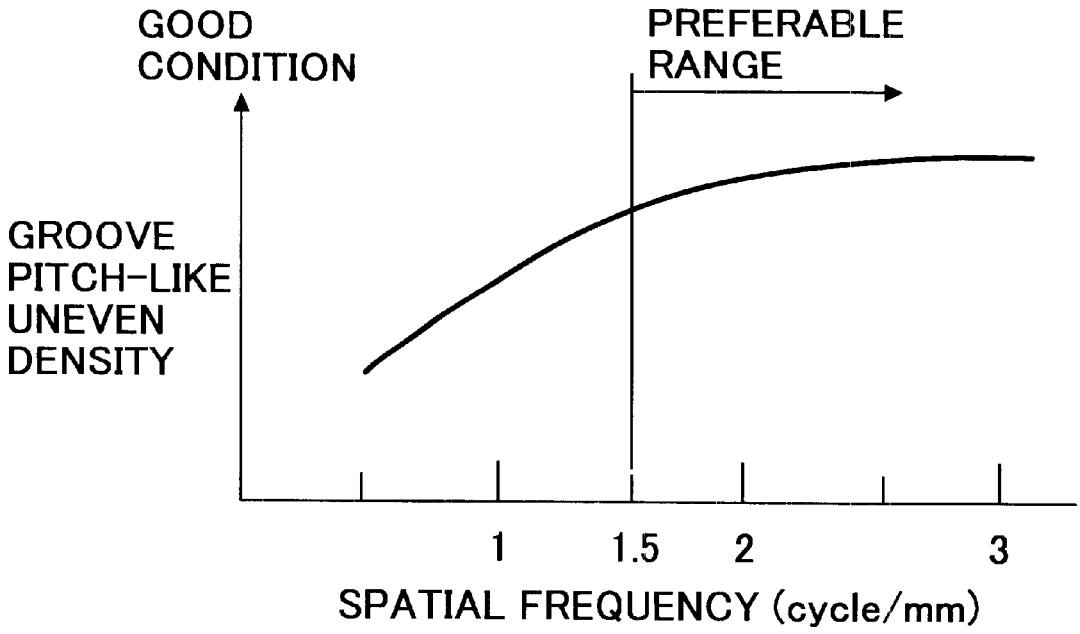
FIG. 13 is a graph showing a relationship between a spatial frequency of an image caused by the grooves of the developing sleeve and a condition of groove pitch-like uneven density based on experimental results.

FIG. 13 is a graph showing a relationship between a spatial frequency of an image caused by the grooves of the developing sleeve 43 and a condition of groove pitch-like uneven density based on experimental results. A toner image formed on the photoconductive drum 1 is transferred onto the recording sheet 6 substantially as it is. Therefore, a spatial frequency (f) equals a number of grooves of the developing sleeve 43 passing the surface of the photoconductive drum 1 of 1 mm length in a surface moving direction, and is obtained by the following calculation:

$$E \times F/(G \times \pi) \quad (2)$$

where (E) is a ratio of linear velocity of the developing sleeve 43 to linear velocity of the photoconductive drum 1, and (F) is a number of grooves of the developing sleeve 43, and (G) is an outer diameter of the developing sleeve 43.

In the present embodiment, the groove pitch-like uneven density is prevented by setting the spatial frequency of an image caused by the grooves of the developing sleeve 43 to 1.5 cycle/mm or greater. Specifically, the ratio of linear velocity of the developing sleeve 43 relative to the linear velocity of the photoconductive drum 1 (E) is set to 2, the number of grooves of the developing sleeve 43 (F) is set to 100, and the outer diameter of the developing sleeve 43 (G) is set to 25 mm. When applying these values to the calculation (2), the spatial frequency (f) is obtained as 2.5 cycle/mm. In this condition, the occurrence of groove pitch-like uneven density can be effectively suppressed.

Figure 14:
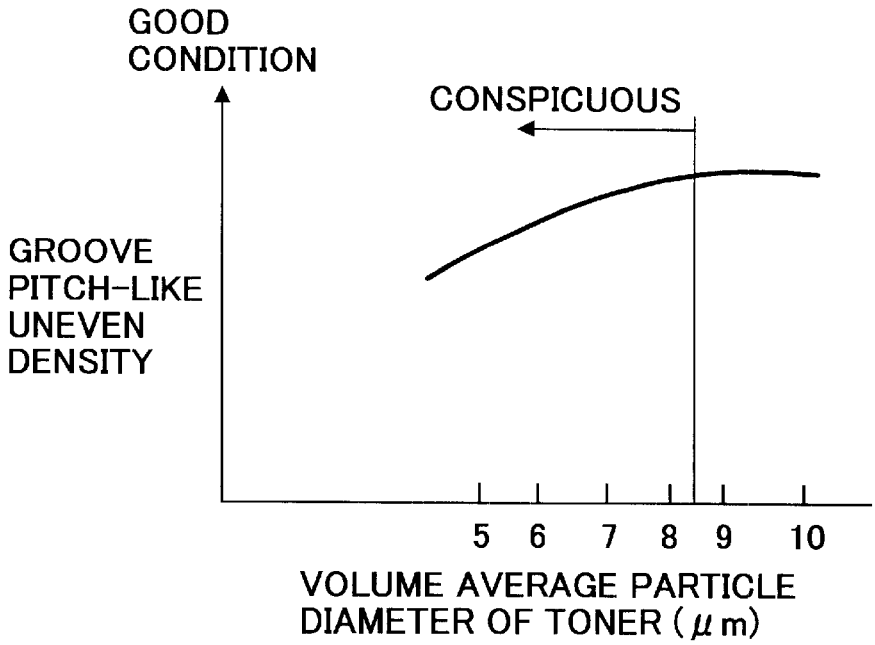
FIG. 14 is a graph showing a relationship between a volume average particle diameter of toner and a condition of groove pitch-like uneven density based on experimental results.

FIG. 14 is a graph showing a relationship between a volume average particle diameter of toner and a condition of groove pitch-like uneven density based on experimental results. Generally, as illustrated in FIG. 14, when forming an image by use of toner having a volume average particle diameter of about 8.5 $\mu$m or less, because the reproducibility of an image remarkably enhances, the groove pitch-like uneven density tends to be conspicuous. In the printer according to the embodiment of the present invention, a high quality image can be formed while preventing the occurrence of groove pitch-like uneven density and enhancing image reproducibility by use of the developing sleeve 43 with the above-described features, even when the toner having a volume average particle diameter of about 8.5 $\mu$m or less is used. If toner has a volume average particle diameter of less than about 4 $\mu$m, the residual toner remaining on the photoconductive drum may not be adequately removed therefrom. Therefore, the volume average particle diameter of toner is preferably about 4 $\mu$m or greater.

Further, the developer for use in the printer according to the present embodiment includes a magnetic particle such as carrier having a volume average particle diameter of about 60 $\mu$m or less. Generally, a two-component developer including a magnetic particle having a volume average particle diameter of about 70 $\mu$m has been often used. In this embodiment, by use of the developer including a magnetic particle having a volume average particle diameter of about 60 $\mu$m or less, a high quality image can be effectively obtained.

Figure 15:
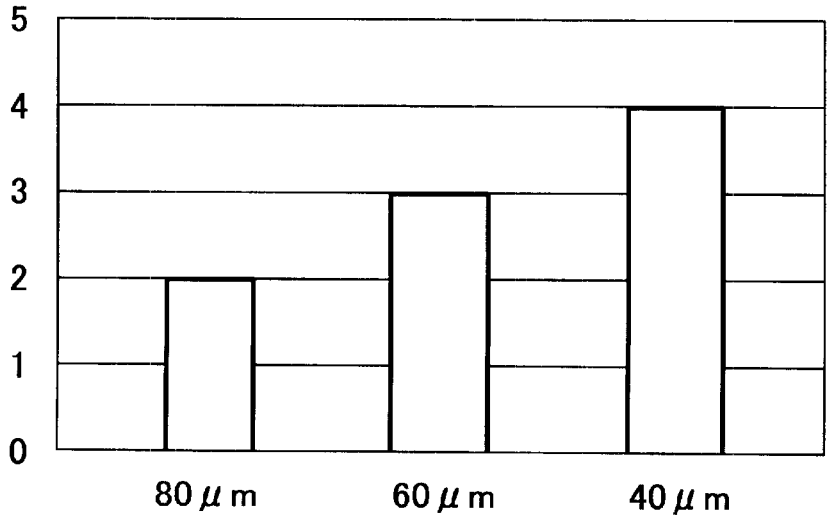
FIG. 15 is a graph showing a relationship between a volume average particle diameter of a magnetic particle and granularity of an image.

FIG. 15 is a graph showing a relationship between a volume average particle diameter of a magnetic particle and granularity of an image formed with a developer including the magnetic particle. Three types of developers including magnetic particles of different volume average particle diameters, i.e., 80 $\mu$m, 60 $\mu$m, and 40 $\mu$m, were used for evaluation of granularity of an image. The evaluation of the granularity of an image was made on a six-level basis, where the most desirable image exhibiting superior image dot reproducibility was evaluated as level 5, and the most undesirable image exhibiting inferior image dot reproducibility was evaluated as level 0. As seen from FIG. 15, the level of the image when using the magnetic particle having a volume average particle diameter of about 80 $\mu$m was 2, the level of the image when using the magnetic particle having a volume average particle diameter of about 60 $\mu$m was 3, and the level of the image when using the magnetic particle having a volume average particle diameter of about 40 μm was 4. It was found that as the volume average particle diameter of the magnetic particle decreased, an image exhibited superior image dot reproducibility. Thus, a high quality image,can be effectively obtained when an image is formed by use of the developer including a magnetic particle having a volume average particle diameter of about 60 μm or less.

Figure 16:
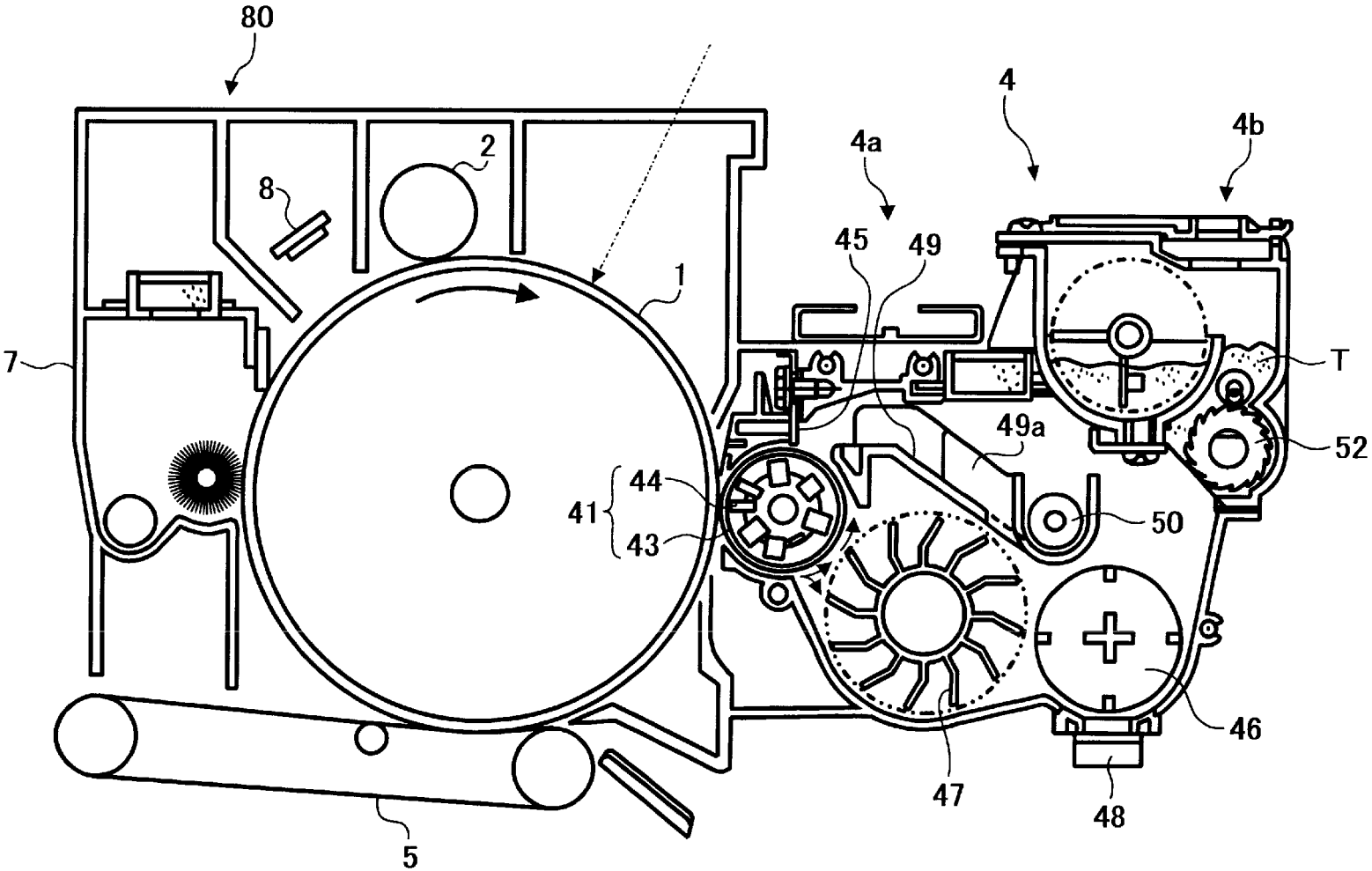
FIG. 16 is a schematic view of a printer according to an alternative example.

FIG. 16 is a schematic view of a printer according to an alternative example. The printer of FIG. 16 includes a process cartridge 80 in the main body of the printer. As illustrated in FIG. 16, the photoconductive drum 1, the charging device 2, the developing device 4, the cleaning device 7, and the discharging device 8 are integrally accommodated in the process cartridge 80. The process cartridge 80 is replaced with a new one when its useful lifetime ends, and is detachably attachable to the main body of the printer. Therefore, the maintenance of the apparatus and replacements of parts can be easily and smoothly carried out. The construction of the process cartridge 80 is not limited to the one shown in FIG. 16. As an alternative construction, the process cartridge 80 may integrally accommodate at least the photoconductive drum 1 and the developing device 4.

The present invention has been described with respect to the embodiments as illustrated in the figures. However, the present invention is not limited to the embodiment and may be practiced otherwise.

The present invention has been described with respect to an electrophotographic printer as an example of an image forming apparatus. However, the present invention may be applied to other image forming apparatuses such as a copying machine or a facsimile machine.

Numerous additional modifications and variations of the present invention are possible in light of the above teachings. It is therefore to be understood that within the scope of the appended claims, the present invention may be practiced otherwise than as specifically described herein.

What is claimed:

1. A developer carrier comprising:

a developer carrying surface configured to carry a developer thereon to develop a latent image formed on an image carrier, said developer carrying surface including a plurality of grooves to carry the developer, wherein dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

2. The developer carrier according to claim 1, wherein the dispersion D (%) is at least approximately 5%.

3. The developer carrier according to claim 1, wherein the depth of the plurality of grooves is from about 0.05 mm to about 0.15 mm.

4. The developer carrier according to claim 1, wherein each of the plurality of grooves has a V-shaped cross-section.

5. A developing device for developing a latent image formed on an image carrier, comprising:

a developer carrier comprising:

a developer carrying surface configured to carry a developer thereon to develop a latent image formed on an image carrier, said developer carrying surface including a plurality of grooves to carry the developer, wherein dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

6. The developing device according to claim 5, wherein the dispersion D (%) is at least approximately 5%.

7. The developing device according to claim 5, wherein the depth of the plurality of grooves is from about 0.05 mm to about 0.15 mm.

8. The developing device according to claim 5, wherein the developer includes toner having a volume average particle diameter of at most about 8.5 μm.

9. The developing device according to claim 5, wherein the developer is a two-component developer including toner and magnetic particle, and wherein a volume average particle diameter of the magnetic particle is at most about 60 μm.

10. An image forming apparatus, comprising:

an image carrier configured to carry an image;

a latent image forming device configured to form an electrostatic latent image on a surface of the image carrier; and a developing device configured to develop the electrostatic latent image to form a toner image on the image carrier, the developing device comprising:

a developer carrier comprising:

a developer carrying surface configured to carry a developer thereon to develop a latent image formed on an image carrier, said developer carrying surface including a plurality of grooves to carry the developer, wherein dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

11. The image forming apparatus according to claim 10, wherein the dispersion D (%) is at least approximately 5%.

12. The image forming apparatus according to claim 10, wherein the depth of the plurality of grooves is from about 0.05 mm to about 0.15 mm.

13. The image forming apparatus according to claim 10, wherein a spatial frequency "f" which is caused by the plurality of grooves and which is calculated according to a following equation is at least approximately 1.5 cycle/mm:

$$f=E\times F/(G\times\pi)$$

where E is a ratio of linear velocity of the developer carrier to linear velocity of the image carrier, F is a number of the plurality of grooves, and G is an outer diameter of the developer carrier.

14. The image forming apparatus according to claim 10, wherein the developer includes toner having a volume average particle diameter of at most about 8.5 μm.

15. The image forming apparatus according to claim 10, wherein the developer is a two-component developer including toner and magnetic particle, and wherein a volume average particle diameter of the magnetic particle is at most about 60 μm.

16. A process cartridge for use in an image forming apparatus, comprising:

an image carrier configured to carry an image;

a developing device configured to develop an electrostatic latent image to form a toner image on the image carrier, the developing device comprising:

a developer carrier comprising:

a developer carrying surface configured to carry a developer thereon to develop a latent image formed on an image carrier, said developer carrying surface including a plurality of grooves to carry the developer, wherein dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

17. The process cartridge according to claim 16, wherein the dispersion D (%) is at least approximately 5%.

18. The process cartridge according to claim 16, wherein the depth of the plurality of grooves is from about 0.05 mm to about 0.15 mm.

19. The process cartridge according to claim 16, wherein a spatial frequency "f" which is caused by the plurality of grooves and which is calculated according to a following equation is at least approximately 1.5 cycle/mm:

$$f=E\times F/(G\times\pi)$$

where E is a ratio of linear velocity of the developer carrier to linear velocity of the image carrier, F is a number of the plurality of grooves, and G is an outer diameter of the developer carrier.

20. The process cartridge according to claim 16, wherein the developer includes toner having a volume average particle diameter of at most about 8.5 $\mu$m.

21. The process cartridge according to claim 16, wherein the developer is a two-component developer including toner and magnetic particle, and wherein a volume average particle diameter of the magnetic particle is at most about 60 $\mu$m.

22. An image forming apparatus, comprising:

image carrying means for carrying an image;

forming means for forming an electrostatic latent image on a surface of the image carrying means; and developing means for developing the electrostatic latent image to form a toner image on the image carrying means, the developing means comprising:

developer carrying means for carrying the developer on a developer carrying surface, the developer carrying surface including a plurality of grooves to carry the developer, wherein dispersion D (%) in depth of the plurality of grooves which is calculated according to a following equation is at most approximately 30%:

$$D(\%)=\{(A-B)/2\}/C$$

where A is a maximum depth of the plurality of grooves, B is a minimum depth of the plurality of grooves, and C is an average depth of the plurality of grooves.

23. The image forming apparatus according to claim 22, wherein the dispersion D (%) is at least approximately 5%.

24. The image forming apparatus according to claim 22, wherein the depth of the plurality of grooves is from about 0.05 mm to about 0.15 mm.

25. The image forming apparatus according to claim 22, wherein a spatial frequency "f" which is caused by the plurality of grooves and which is calculated according to a following equation is at least approximately 1.5 cycle/mm:

$$f=E\times F/(G\times\pi)$$

where E is a ratio of linear velocity of the developer carrying means to linear velocity of the image carrying means, F is a number of the plurality of grooves, and G is an outer diameter of the developer carrying means.

26. The image forming apparatus according to claim 22, wherein the developer includes toner having a volume average particle diameter of at most about 8.5 $\mu$m.

27. The image forming apparatus according to claim 22, wherein the developer is a two-component developer including toner and magnetic particle, and wherein a volume average particle diameter of the magnetic particle is at most about 60 $\mu$m.

28. The developer carrier according to claim 1, wherein the plurality of grooves extend in a direction substantially perpendicular to a moving direction of the developer carrying surface.

* * * * *

UNITED STATES PATENT AND TRADEMARK OFFICE

CERTIFICATE OF CORRECTION

PATENT NO. : 6,681,092 B2
DATED : January 20, 2004
INVENTOR(S) : Terai

It is certified that error appears in the above-identified patent and that said Letters Patent is hereby corrected as shown below:

Title page,
Item [30], Foreign Application Priority Data, should read:
-- [30] Foreign Application Priority Data
Feb. 4, 2002 (JP) …….. 2002-026842
Jan. 6, 2003 (JP) …….. 2003-000118 --

Signed and Sealed this

Eleventh Day of May, 2004

JON W. DUDAS
*Acting Director of the United States Patent and Trademark Office*